US005579855A

United States Patent [19]

Dickey

[11] Patent Number: 5,579,855

[45] Date of Patent: Dec. 3, 1996

[54] ROTARY CONE ROCK BIT AND METHOD

[76] Inventor: Winton B. Dickey, Rte. 2 Box 86, Alvin, Tex. 77511

[21] Appl. No.: 503,376

[22] Filed: Jul. 17, 1995

[51] Int. Cl.[6] ..... E21B 10/18

[52] U.S. Cl. ..... 175/340; 175/393; 175/424

[58] Field of Search ..... 175/339, 340, 175/393, 424, 429

[56] References Cited

U.S. PATENT DOCUMENTS

| | | | |
|---|---|---|---|
| 2,137,261 | 11/1938 | Boll et al. | 175/17 |
| 3,070,182 | 12/1962 | Runte | 175/339 |
| 3,655,001 | 4/1972 | Hoffman | 175/213 |
| 3,934,659 | 1/1976 | Tsiferov | 175/17 |
| 4,187,921 | 2/1980 | Garner | 175/340 |
| 4,189,014 | 2/1980 | Allen et al. | 175/339 |
| 4,392,534 | 7/1983 | Miida | 175/340 |
| 4,512,421 | 4/1985 | Ogahara | 175/17 |
| 4,516,642 | 5/1985 | Childers et al. | 175/340 |
| 4,546,837 | 10/1985 | Childers et al. | 175/340 |
| 4,615,399 | 10/1986 | Schoeffler | 175/215 X |
| 4,619,335 | 10/1986 | McCoullough | 175/340 X |
| 4,665,999 | 5/1987 | Shoemaker | 175/340 |
| 4,673,045 | 6/1987 | McCoullough | 175/340 X |
| 4,687,066 | 8/1987 | Evans | 175/340 |
| 4,687,067 | 8/1987 | Smith et al. | 175/340 |
| 4,784,231 | 11/1988 | Higgins | 175/340 |

*Primary Examiner*—Roger J. Schoeppel
*Attorney, Agent, or Firm*—Keeling Law Firm

[57] ABSTRACT

An improved rotary cone rock bit that provides a cross flow through the drill bit dome to reduce bailing and improve the efficiency of the drilling operation. The rotary cone rock bit has a bit body with a pin at its upper end adapted to connect to a drill string. The lower end of the bit body has three leg segments extending from its periphery in a downward direction. Drilling cones rotatably mounted to each leg segment provide the cutting action of the rock bit. The conical drilling cones extend from the leg segments toward the center axis of the rotary cone rock bit with the smaller diameter end distal the leg segments. The rotary cutter cones and the lower end of the bit body define a dome therebetween. Nozzles extend downward from the base areas between the leg segments. The nozzles are in flow communication with an opening in the bit body that transmits fluid from the drill string therethrough. The nozzles direct fluid toward the dome to create a Cross flow therethrough. The rock bit may include any number of nozzles and may combine the nozzles with others that direct fluid toward the bottom of the bore hole for increased lubrication. Basically, the nozzles include a body having a longitudinal cavity therein. A nozzle exit directs fluid from the cavity and direct the fluid toward the dome. Alignment dowels ensure that the nozzle exit remains aligned toward the dome.

19 Claims, 2 Drawing Sheets

ROTARY CONE ROCK BIT AND METHOD

BACKGROUND OF THE INVENTION

1. Field of Invention

This invention relates to a rotary cone rock bit. More specifically, it is directed to an improved rotary cone rock bit that includes radially directed nozzles to provide a cross flow through the drill bit dome and, thereby, reduce the accumulation of mud and a method for accomplishing same.

Rotary cone rock bits use drilling fluid, or mud, as a lubricant. The mud circulates down through a drill string, into the rock bit body, through nozzles positioned at the bottom of the rock bit, and toward the bottom of the well bore. In soft formations, the nozzles are particularly useful because the relatively high pressure mud creates a turbulence within the hole and stirs up formation cuttings facilitating their circulation from the well bore. From the well bore bottom, the mud circulates back to the surface carrying formation cuttings therewith.

Typically, however, the rotary cones of a rotary cone rock bit define a dome or cavity between the cones. Drilling mud and formation cuttings accumulate within the dome. The accumulation forms a mud ball and becomes impacted. This process is referred to generally as "bailing." Balling reduces the efficiency of the drilling because a portion of the cutting energy is consumed when the rotary cones act on the impacted mud ball. Thus, eliminating balling results in greater drilling efficiency.

2. Related Art

A number of devices attempt to solve the problem of balling. Illustrative of such devices is U.S. Pat. No. 4,665,999 that issued to Shoemaker on May 19, 1987. Shoemaker discloses variable length three-cone rock bit nozzles that, due to their varying lengths, create a cross flow through the drill bit dome.

Another prior effort to design a rock bit that reduces balling is U.S. Pat. No. 4,687,066 that issued to Evans on Aug. 18, 1987. Evans shows a rock bit having axially mounted angled nozzles that create a downwardly spinning vortex within the drill cavity. The purpose of the vortex is to sweep cuttings away from the cutting surfaces.

A further prior effort to reduce balling is U.S. Pat. No. 4,687,067 that issued to Smith et al. on Aug. 18, 1987. Smith et al. reveals a cross-flow rotary three cone rock bit with extended nozzles that creates the cross flow by providing nozzles on only two of the three leg segments.

Though the above mentioned rock bit nozzles may be helpful in reducing balling, they can be improved to provide more effective and efficient cross flow through the drill bit dome and, thus, better reduce balling.

SUMMARY OF THE INVENTION

Accordingly, the objectives of this invention are to provide, inter alia, an improved rotary cone rock bit that:

- provides greater drilling efficiency than previous rotary cone rock bits;
- provides sufficient lubrication for the rotary cone cutters;
- reduces balling within the dome of the rotary cone rock bit;
- creates a cross flow through the drill bit dome;
- utilizes nozzles with exits directed toward the dome to create the cross flow;

- includes a means of aligning and maintaining alignment of the nozzles; and
- is low in cost, easy to use, and easy to implement.

To achieve such improvements, my invention is an improved rotary cone rock bit that includes nozzles that have radially aligned exits positioned and constructed to direct fluid toward the rotary cone rock bit dome.

Generally, the rotary cone rock bit comprises a bit body having an upper end, a lower end, and a vertically-aligned axis. A pin at the upper end of the bit body selectively connects the rotary cone rock bit to a drill string. Preferably, the pin is sized and constructed to threadably mate with the drill string. Attached to the lower end of the bit body, a plurality of leg segments, preferably three, extend circumferentially therefrom. On the lower end of the bit body, the leg segments define a plurality of base areas therebetween. Rotatably mounted to each of the leg segments, a rotary cutter cone extends inwardly toward the axis of the bit body. The rotary cone cutters are conical and have a base end and an apex end. The diameter of the rotary cone cutter decreases from the base end to the apex end. The base end of each rotary cone cutter is mounted proximal a leg segment. Therefore, with a plurality of rotary cone cutters so mounted, the rotary cone cutters and the bit body lower end define a drill bit dome therebetween. Extending longitudinally into the bit body from the upper end, an opening provides flow communication with the drill string.

In flow communication with the opening, at least one cross-flow nozzle means facilitates reduction of balling within the drill bit dome. To provide the cross flow, the cross-flow nozzle means is attached and positioned at one of the base areas and directs fluid toward the drill bit dome. Preferably, the cross-flow nozzle means is radially offset from the bit body axis. In this way, the cross-flow nozzle means creates a cross flow and reduces balling.

In the preferred embodiment, the cross-flow nozzle means comprises a nozzle body having a top end and a bottom end. A longitudinal nozzle body cavity extends from the top end of the nozzle body partially therethrough. Preferably, the upper end of the nozzle body cavity has a diameter that decreases in diameter in the downstream direction. The nozzle body top end attaches to the bit body lower end. When the nozzle body is attached to the bit body, the longitudinal nozzle body cavity is in flow communication with the opening. A first nozzle exit directs fluid from the nozzle body cavity toward the drill bit dome, preferably radially therefrom. Typically, the bit body axis is vertically aligned and parallel to the bit body axis. To provide for acceleration of the fluid from the cavity, the cross-sectional area of the cavity must be greater than the cross-sectional area of the exit.

The nozzle body may also contain a second nozzle exit constructed and positioned to direct fluid from the nozzle body cavity toward the bottom of the bore hole. Thus, in a nozzle body having a vertically-aligned axis, the second nozzle exit preferably directs fluid in an axial direction. As in a nozzle body having only a first nozzle exit, to provide for acceleration of the fluid from the nozzle cavity, the cross-sectional area of the cavity must be greater than the combined cross-sectional area of the first and second exit.

To maintain proper alignment of the nozzle body in the bit body and ensure that the accelerated fluid is directed at the bit body cavity, the nozzle body includes an aligning means. Generally, the aligning means comprises one or more dowels attached to the top end of the nozzle body. Matching dowel receiving holes in the bit body, receive and mate with the dowels to maintain the alignment of the nozzle body.

In a bit body having three leg segments, the bit body may include one, two, or three cross-flow nozzles to obtain a cross flow through the drill bit dome. Consequently, the bit body may include an axial-flow nozzle in the base areas not containing a cross-flow nozzle. Basically, an axial-flow nozzle has an axial-flow nozzle body with a top end and a bottom end. A cavity in the axial-flow nozzle extends longitudinally from the top end partially therethrough. When the top end of the axial-flow nozzle is operatively attached to the bit body lower end, the axial-flow nozzle body cavity is in flow communication with the opening in the bit body. An axial-flow nozzle exit in the axial-flow nozzle body directs fluid from the cavity toward the bottom of the bore hole. Preferably, the axial-flow nozzle body axis and the bit body axis are parallel and the exit directs fluid in the axial direction. Providing axial-flow nozzles in the base areas that do not include a cross-flow nozzle, improves the lubrication at the bore hole bottom.

Functionally applying the above described apparatus provides a method of reducing mud accumulation at the center of a rotary cone rock bit's drilling cones and, thereby, improves the effectiveness of the cross flow and the efficiency of the drilling operation.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
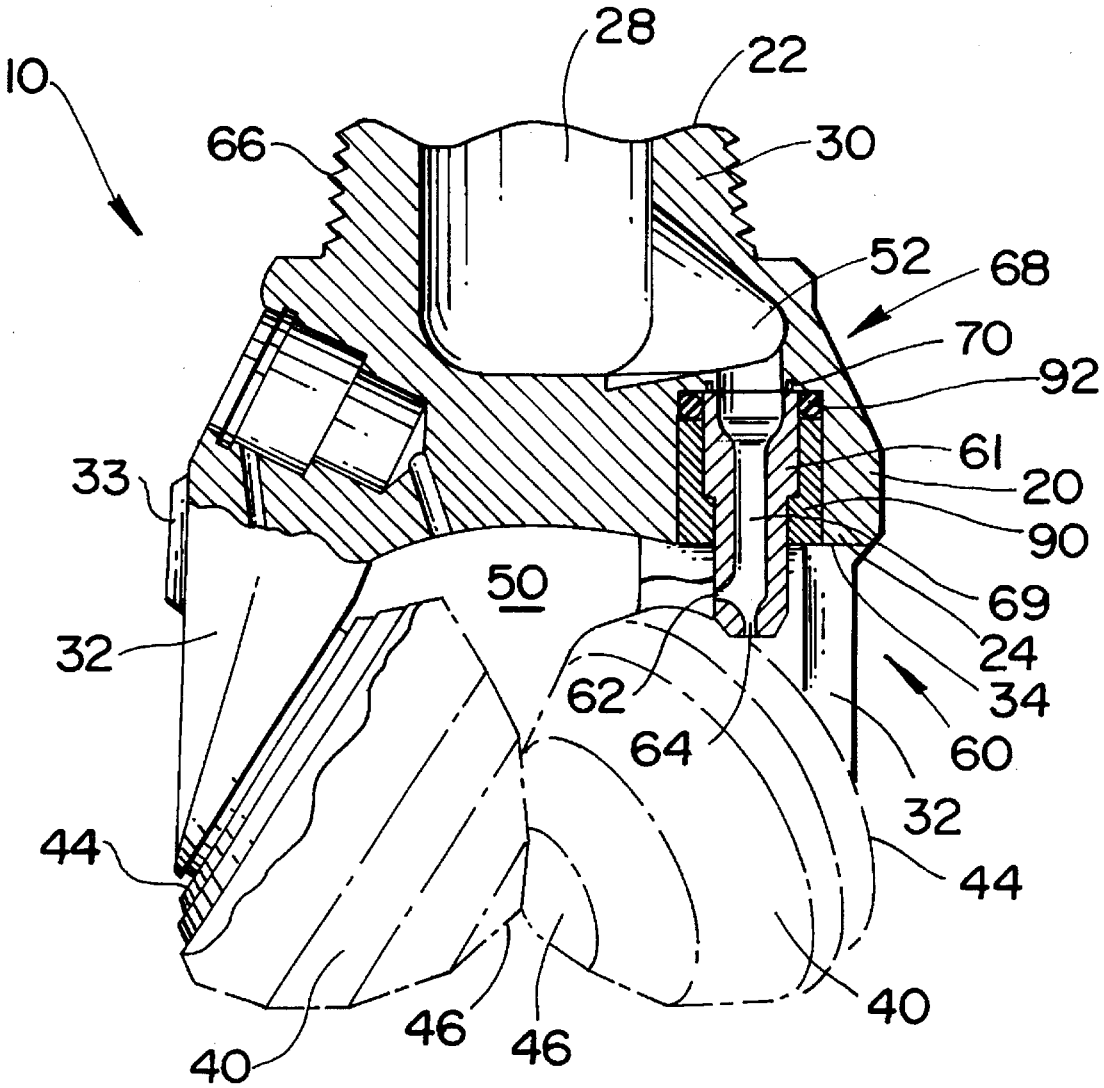
FIG. 1 is an isometric, partial sectional view of the improved rotary cone rock bit having a cross-flow nozzle therein.
Figure 2:
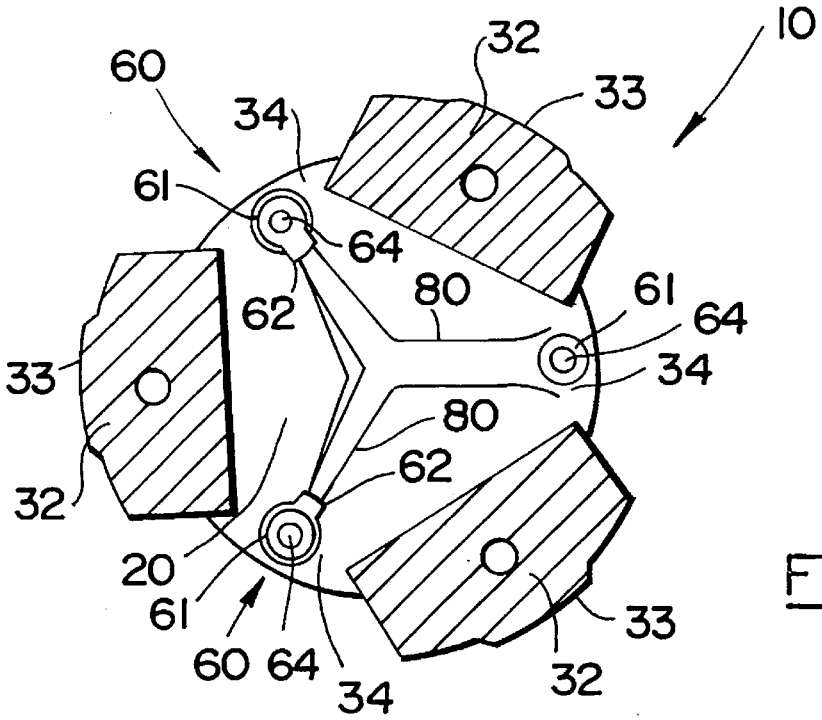
FIG. 2 is a bottom cross-sectional view of an improved rotary cone rock bit having two cross-flow nozzles and one axial-flow nozzle and shows the resulting cross flow of said arrangement.
Figure 3:
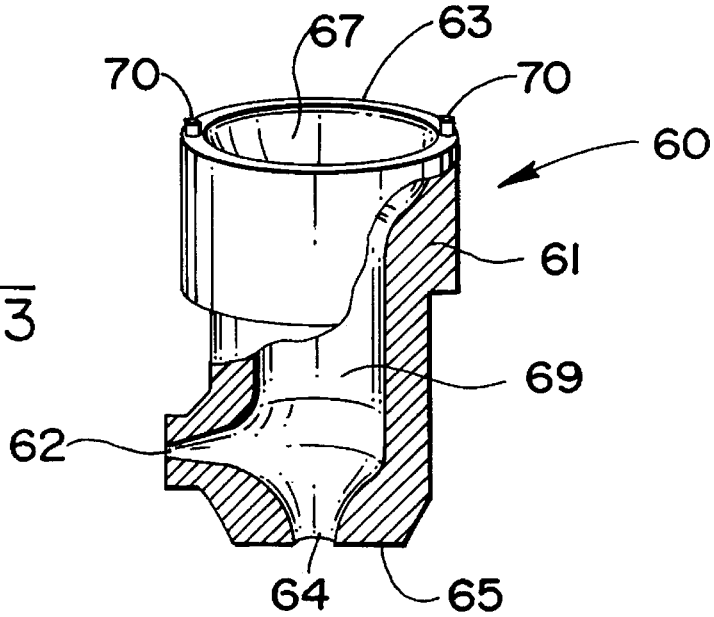
FIG. 3 is an isometric, partial sectional view of a cross-flow nozzle.

The preferred embodiment of my invention is illustrated in FIGS. 1 through 3 and the improved rotary cone rock bit is depicted as 10.

Generally, a rotary cone rock bit 10 comprises a bit body 20, a pin 30, a plurality of leg segments 32, and a rotary cutter cone 40 extending from each of the leg segments 32.

The bit body has an upper end 22, a lower end 24, and a vertically-aligned axis. Attached to the upper end 22 of the bit body 20, the pin 30 provides for selective attachment of the rotary cone rock bit 10 to a drill string. Preferably, the pin 30 is sized and constructed with threads on a threaded portion 66 to threadably mate with the drill string. Alternatively, the pin 30 could be fixedly attached to the drill string (e.g. by welding).

A plurality of leg segments 32 extend from the lower end 24 of the bit body 20. Each leg segment 32 extends in a generally downward direction. The leg segments 32 are substantially equally spaced from one another and extend from the periphery of the bit body 20. In the preferred embodiment, the rotary cone rock bit 10 has three leg segments 32.

Rotatably attached to each of the leg segments 32, a rotary cutter cone 40 provides the drilling and cutting action of the rotary cone rock bit 10. Each rotary cutter cone 40 has a base end 44, an apex end 46, and an axis. The diameter of the rotary cutter cone 40 generally decreases from the base end 44 to the apex end 46. Hence, the rotary cutter cone 40 has a generally conical shape.

Each rotary cutter cone 40 attaches to its corresponding leg segment 32 at the base end 44 of the rotary cutter cone 40. Thus, the apex end 46 is distal the leg segment 32. From the leg segment 32, the rotary cutter cone 40 extends at an angle downward toward the axis of the bit body 20. Consequently, the apex end 46 is proximal the axis of the bit body 20; and the apex ends 46 of the plurality of rotary cutter cones 40 are proximal one another. As described, the rotary cutter cones 40 and the bit body lower end 24 define a drill bit dome 50 therebetween.

At the lower end 24 of the bit body 20, each pair of adjacent leg segments 32 define a base area 34. The base area 34 is simply the surface of the bit body 20 at the lower end 24 between adjacent leg segments 32.

Extending longitudinally into the bit body 20 from the upper end 22 through the pin 30, an opening 28 provides flow communication with the drill string. The opening 28 is sized to communicate sufficient fluid from the drill string to the well bore bottom for efficient drilling.

In flow communication with the opening 28, at least one cross-flow nozzle means 60 provides a cross flow of fluid through the drill bit dome 50 of the rotary cone rock bit 10. Effectively, the resultant cross flow of fluid reduces balling in the drill bit dome 50. The cross-flow nozzle means 60 is attached and positioned at one of the base areas 34 and directs fluid toward the drill bit dome 50 of the rotary cone rock bit 10. Preferably, the cross-flow nozzle means 60 is radially offset from the axis of the bit body 20 and directs fluid in a substantially radial direction.

In the preferred embodiment, the cross-flow nozzle means 60 comprises a nozzle body 61, a nozzle body cavity 69 in flow communication with the opening 28, and a first nozzle exit 62. sized, constructed, and positioned to direct fluid from the nozzle body cavity 69 toward the drill bit dome 50.

The nozzle body 61 has a nozzle body top end 63 and a nozzle body bottom end 65. The nozzle body top end 63 attaches to the lower end 24 of the bit body 20. This attachment may be accomplished in a variety of ways including threaded engagement, integral attachment, etc. To facilitate attachment of the nozzle body 61, the nozzle body 61 typically extends partially into the lower end 24 of the bit body 20. A packing insert 90 constructed to mate with the bit body 20 maintains the nozzle body 61 in the bit body 20. An o-ring 92 or other seal placed between the packing insert 90 and the bit body 20 prevents fluid from leaking through the connections between the packing insert 90, the bit body 20, and the nozzle body 61.

For simplicity of design and implementation, the nozzle body 61 in the preferred embodiment includes a vertically aligned nozzle body axis that is parallel to the axis of the bit body 20. The outer cross-sectional shape of the nozzle body 61 is preferably circular.

A nozzle body cavity 67 extends longitudinally from the nozzle body top end 63 partially therethrough. Preferably, the nozzle body cavity 67 has a circular cross-section; and the upper portion 67 of the nozzle body cavity 67 has a variable diameter that decreases in a downstream direction. A communication means 52 provides flow communication between the nozzle body cavity 69 and the bit body opening 28. Therefore, the fluid from the drill string flows through the opening 28, through the communication means 52, and to the nozzle body cavity 69. Generally, the communication means 52 comprises a passageway formed in the bit body 20.

A first nozzle exit 62 directs fluid from the nozzle body cavity 69 toward the drill bit dome 50. Accordingly, to accomplish the acceleration of the fluid, the cross-sectional area of the first nozzle exit 62 must be less than the cross-sectional area of the nozzle body cavity 69. Thus, the fluid within the relatively large nozzle body cavity 69 flows through the relatively small first nozzle exit 62 and accelerates. To create the cross flow through the drill bit dome 50, the first nozzle exit 62 is sized, constructed, and positioned to direct the fluid from the nozzle body cavity 69 toward the drill bit dome 50. Although the first nozzle exit 64 may direct the accelerated fluid at any angle toward the drill bit dome 50, preferably the first nozzle exit 62 is directed radially. Both FIGS. 1 and 3 show the first nozzle exit 62 as a radially directed circular opening in the wall of the nozzle body 61.

To enhance the lubrication at the bore hole bottom, the nozzle body 61 may include a second nozzle exit 64 that directs fluid from the nozzle body cavity 69 toward the bottom of the bore hole. As shown in FIGS. 1 and 3, nozzle body 61, having a vertically-aligned axis, includes a second nozzle exit 64, with a circular cross-section, that directs fluid in a downward, axial direction. As in the cross-flow nozzle means 60 having only a first nozzle exit 62, the cross-sectional area of the nozzle body cavity 69 is greater than the combined cross-sectional area of the first nozzle exit 62 and the second nozzle exit 64 to provide for the acceleration of the fluid through the exits 62 and 64. This ratio is necessary to provide for the acceleration of the fluid from the nozzle body cavity 69.

Because the mud that accumulated in the drill bit dome 50 is substantially liquid, before impaction, removal of the mud from the drill bit dome 50 requires less fluid flow than is required for lubrication of the cutting process at the bore hole bottom. As shown in FIG. 3, the first nozzle exit 62 has a smaller cross-sectional area than the second nozzle exit 64. With the nozzles, 62 and 64, having these relative cross-sectional areas the Jetting action from the first nozzle exit 62 is less than the Jetting action from the second nozzle exit 64. In addition, because the direction of the fluid flow through the first nozzle exit 62 changes direction, the fluid flow through the first nozzle exit 62 is unaided by the momentum of the fluid flow into the nozzle body cavity 69. The fluid flow through the second nozzle exit 64 is aided the momentum of the fluid flow into the nozzle body cavity 69. Accordingly, because the second nozzle exit 64 utilizes the momentum of the inlet flow whereas the first nozzle exit 62 does not, the difference in the Jetting action between the nozzle exits, 62 and 64, is further enhanced. As a result, the fluid flow directed at the drill bit dome 50 is less than the fluid flow directed at the bore hole bottom. In this way, the fluid flow is directed to the drill bit dome 50 and the bore hole bottom in proportion to their need.

To maintain the proper alignment of the nozzle body 61 in the bit body 20 and ensure that the first nozzle exit 62 directs accelerated fluid toward the drill bit dome 50, the cross-flow nozzle means 60 includes an aligning means 68. The purpose of the first nozzle exit 62 is to direct fluid toward the drill bit dome 50. Therefore, proper alignment of the first nozzle exit 62 is vital to creation of a cross flow through the drill bit dome 50. Under the harsh conditions of drilling a well bore, a nozzle body 61 could easily become misaligned. Consequently, the alignment means 68 is required to assure effective cross flow. Preferably, the alignment means comprises one or more dowels 70 connected to the nozzle body top end 63. Connection of the dowels 70 to the nozzle body 61 may be accomplished by integral connection, sliding receipt, cooperating cam means, or other connecting means. The dowels 70 mate with corresponding dowel receiving holes in the bit body 20 to prevent rotation of the nozzle body 61 and the resultant misalignment of the first nozzle exit 62.

A rotary cone rock bit 10 may contain any number of cross-flow nozzle means 60 up to the number of base areas 34 on the bit body 20. For example, a rotary cone rock bit 10 having three leg segments 32 and, thus, three base areas 34 may include one, two, or three cross-flow nozzle means 60. Those base areas not occupied by a cross-flow nozzle means 60 may simply be left open and contain no nozzle. In the alternative, the base areas 34 not occupied by a cross-flow nozzle means 60 may contain an axial-flow nozzle means, as shown in FIG. 2 wherein the resulting flow lines are depicted as 80. By including the axial flow nozzle means in the base areas not occupied by a cross-flow nozzle means 60, the rotary cone rock bit 10 provides better lubrication of the bore hole bottom.

An axial flow nozzle means is simply a nozzle that has only a second nozzle exit 64 and directs accelerated fluid toward the bore hole bottom. Therefore, an axial flow nozzle means basically comprises an nozzle body 61, a nozzle body cavity 69 that extends longitudinally from the nozzle body top end 63 partially therethrough in communication with the bit body opening 28, and a nozzle exit 64 sized, positioned, and constructed to direct fluid toward the bottom of the bore hole. Preferably, the axial flow nozzle body axis and the bit body axis parallel; and the nozzle exit 64 directs fluid in an axial direction. Attachment of the axial-flow nozzle means, as well as other, previously mentioned, general design considerations, are accomplished in the same manner as in the cross-flow nozzle means 60.

In addition to varying the number of cross-flow nozzle means 60 in the rotary cone rock bit 10, the cross flow may be improved by employing a variety of other design variations. One such variation is to direct the first nozzle exits 62 of each cross-flow nozzle means 60 at different locations within the drill bit dome 50. A second variation is to provide nozzle bodies 61 that each have a different length or have first nozzle exits 62 positioned at a different longitudinal position. Another variation is to provide first nozzle exits 62 that are not radially directed but direct fluid at an angle into the drill bit dome 50. Other combinations and variations within the scope and spirit of the present invention are possible.

The above description defines a rotary cone rock bit 10 that reduces accumulation of mud at the drill bit dome 50 by directing a cross flow therethrough. Therefore, functionally applying the above described apparatus provides a method for reducing the accumulation of mud and associated balling effect at the center of a rotary cone rock bit's 10 rotary cutter cones 40. Functional application of this device improves the effectiveness of the cross flow and the efficiency of the drilling operation.

I claim:

1. An improved rotary cone rock bit comprising:

a bit body having an upper end, a lower end, and a vertically-aligned axis;

a pin at said upper end adapted to selectively connect to a drill string;

a plurality of leg segments at said lower end;

a plurality of base areas at said lower end between each pair of adjacent leg segments:

a rotary cutter cone mounted on each of said plurality of leg segments;

said rotary cutter cone having an axis, a base end, and an apex end;

said rotary cutter cone positioned with the base end proximal said bit body lower end and said apex end distal said bit body lower end;

said rotary cutter cone oriented with said rotary cutter cone axis at an angle to said bit body axis wherein the apex end is proximal the bit body axis;

said rotary cutter cones and bit body lower end define a drill bit dome therebetween;

an opening extending into said bit body from said bit body upper end;

at least one cross-flow nozzle means for providing a cross-flow through said drill bit dome in flow communication with said opening in said bit body;

said at least one cross-flow nozzle means attached and positioned at one of said plurality of base areas;

said at least one cross-flow nozzle means constructed to direct fluid toward said drill bit dome;

said at least one cross-flow nozzle means comprising a nozzle body having a nozzle body top end and a nozzle body bottom end;

a nozzle body cavity extending longitudinally from said nozzle body top end;

said nozzle body top end attached to said bit body lower end;

said nozzle body cavity in flow communication with said opening;

a first nozzle exit sized, constructed, and positioned to direct fluid from said nozzle body cavity toward said drill bit dome;

a second nozzle exit in said nozzle means constructed to direct fluid from said nozzle body cavity toward a bottom of a bore hole;

said nozzle body cavity having a greater cross-sectional area than the combined cross-sectional area of said first nozzle exit and said second nozzle exit; and the cross-sectional area of said first nozzle exit is smaller than the cross-sectional area of said second nozzle exit.

2. An improved rotary cone rock bit as claimed in claim 1 wherein said pin is constructed and sized to threadably mate with said drill string.

3. An improved rotary cone rock bit as claimed in claim 1 having three leg segments.

4. An improved rotary cone rock bit as claimed in claim 1 wherein said opening is adapted to provide flow communication with said drill string.

5. An improved rotary cone rock bit as claimed in claim 1 wherein said cross-flow nozzle means is radially offset from said bit body axis.

6. An improved rotary cone rock bit as claimed in claim 1 wherein said first nozzle exit is directed at an angle to the radial direction toward said drill bit dome.

7. An improved rotary cone rock bit as claimed in claim 1 further comprising:

said nozzle body cavity having an upper portion; and said upper portion having a diameter that decreases in a downstream direction.

8. An improved rotary cone rock bit as claimed in claim 1 wherein:

said nozzle body includes a vertically-aligned nozzle body axis; and said nozzle body axis is parallel said bit body axis.

9. An improved rotary cone rock bit as claimed in claim 1 wherein:

said rotary cone rock bit having a plurality of cross-flow nozzle means;

each of said first nozzle exits of said plurality of cross-flow nozzle means positioned at a different axial position from the other of said first nozzle exits.

10. An improved rotary cone rock bit as claimed in claim 1 wherein said first nozzle exit is directed radially toward said bit body axis.

11. An improved rotary cone rock bit as claimed in claim 1 having three cross-flow nozzle means.

12. An improved rotary cone rock bit as claimed in claim 1 wherein:

said nozzle body includes a vertically-aligned nozzle body axis; and said second nozzle exit directs fluid in a nozzle body axial direction.

13. An improved rotary cone rock bit as claimed in claim 1 further comprising an aligning means for maintaining alignment of said first nozzle exit.

14. An improved rotary cone rock bit as claimed in claim 13 wherein said aligning means comprises at least one alignment dowel integral with said nozzle body top end.

15. An improved rotary cone rock bit as claimed in claim 1 further comprising:

at least one axial-flow nozzle means in flow communication with said bit body opening;

said at least one axial-flow nozzle means having a nozzle exit sized and constructed to direct fluid toward said bottom of said bore hole; and each of said axial-flow nozzle means and said cross-flow nozzle means positioned at a separate base area.

16. An improved rotary cone rock bit as claimed in claim 15 wherein said axial-flow nozzle means comprises:

an axial-flow nozzle body having an axial-flow nozzle body top end and an axial-flow nozzle body bottom end;

an axial-flow nozzle body cavity extends longitudinally from said axial-flow nozzle body top end;

said axial-flow nozzle body top end is attached to said bit body lower end;

said axial-flow nozzle body cavity is in flow communication with said opening; and an axial-flow nozzle exit sized, constructed, and positioned to accelerate fluid from said axial-flow nozzle body cavity toward said bottom of said bore hole.

17. An improved rotary cone rock bit as claimed in claim 16 wherein:

said axial-flow nozzle body includes an axial-flow nozzle body axis that is parallel to the bit body axis; and said axial-flow nozzle exit directs fluid in a axial-flow nozzle body axial direction.

18. An improved rotary cone rock bit as claimed in claim 15 having one cross-flow nozzle means.

19. An improved rotary cone rock bit as claimed in claim 15 having two cross-flow nozzle means.

* * * * *